US005298945A

United States Patent [19]

Wada et al.

[11] Patent Number: 5,298,945

[45] Date of Patent: Mar. 29, 1994

[54] ELECTROPHOTOGRAPHIC PRINTING MACHINE

[75] Inventors: Takasumi Wada, Nara; Kimihide Tsukamoto; Tomohiro Oikawa, both of Yamatokoriyama, all of Japan

[73] Assignee: Sharp Kabushiki Kaisha, Osaka, Japan

[21] Appl. No.: 946,920

[22] Filed: Sep. 18, 1992

[30] Foreign Application Priority Data

Sep. 20, 1991 [JP] Japan ..... 3-240977

[51] Int. Cl.[5] ..... G03G 15/00

[52] U.S. Cl. ..... 355/210; 355/271; 355/272; 355/277; 355/279; 355/282; 355/285; 355/290

[58] Field of Search ..... 355/210, 211, 212, 271, 355/272, 277, 279, 282, 285, 289, 290, 295; 346/160, 153.1; 219/216

[56] References Cited

U.S. PATENT DOCUMENTS

| | | | |
|---|---|---|---|
| 3,820,985 | 6/1974 | Gaynor et al. | 355/272 X |
| 3,924,945 | 12/1975 | Weigl | 355/271 X |
| 3,937,572 | 2/1976 | Gaynor et al. | 355/212 X |
| 4,021,106 | 5/1977 | Gaynor et al. | 355/200 |
| 4,458,258 | 7/1984 | Amaya et al. | 346/153.1 |
| 4,486,089 | 12/1984 | Itaya et al. | 355/251 |
| 4,518,976 | 5/1985 | Tarumi et al. | 346/153.1 |
| 4,542,978 | 9/1985 | Tarumi et al. | 355/279 |
| 4,547,787 | 10/1985 | Kaneko et al. . | |
| 4,649,094 | 3/1987 | Tamura et al. . | |
| 4,755,849 | 7/1988 | Tarumi et al. | 355/290 |
| 4,851,926 | 7/1989 | Ishikawa | 346/160 X |
| 4,931,876 | 6/1990 | Hashizume | 346/160 X |
| 5,051,778 | 9/1991 | Watanabe et al. | 355/210 X |
| 5,057,875 | 10/1991 | Itoh | 355/277 X |
| 5,065,187 | 11/1991 | Itoh et al. | 355/215 |
| 5,148,225 | 9/1992 | Takeda et al. | 355/272 |
| 5,162,634 | 11/1992 | Kusaka | 355/289 X |

FOREIGN PATENT DOCUMENTS

| | | |
|---|---|---|
| 0364855 | 4/1990 | European Pat. Off. . |
| 3241816 | 5/2683 | Fed. Rep. of Germany . |
| 59-131958 | 7/1984 | Japan . |

OTHER PUBLICATIONS

*Journal of Applied Physics*, vol. 63, No. 11, Jun. 1, 1988, Tetsutani, N., "Photoreceptor Charging Mechanism by Conductive Particle Rubbing and Application to a Novel Electrophotographic Printing Technology".

*Primary Examiner*—Matthew S. Smith

*Attorney, Agent, or Firm*—David G. Conlin; Robert F. O'Connell; Peter F. Corless

[57] ABSTRACT

An electrophotographic printing machine is provided with a photoreceptor drum including a transparent cylindrical base having a transparent electrically conductive layer and a photoconductive layer laminated in this order on a surface thereof and a dielectric belt in contact with the photoconductive layer. The photosensitive layer is exposed while voltage is being applied across an electrically conductive toner and a transparent electrically conductive layer, thereby forming a toner image on the photosensitive layer. After the toner image on the photosensitive layer is transferred to the dielectric belt which temporarily carries the toner image, the copying material is superimposed on the toner image, and heat and pressure are applied to the toner image respectively from a heater and a pressurizing roller. Since the melted toner is transferred onto the copying material using the adherence of the transfer sheet without using electric Coulomb force, the efficiency in transferring the toner image to the copying material is not affected by the electric surface resistance of the copying material. An image can therefore be formed using the electrically conductive toner even on a copying material of low electric surface resistance such as a normal transfer sheet.

5 Claims, 5 Drawing Sheets

ELECTROPHOTOGRAPHIC PRINTING MACHINE

FIELD OF THE INVENTION

The present invention relates to an electrophotographic printing machine which forms a toner image on a surface of a photoreceptor, and thereafter, transfers the toner image to a copying material to be permanently affixed thereto, thereby forming images.

BACKGROUND OF THE INVENTION

Conventionally, in forming images using toner particles, electrophotography has been generally used, i.e., the application of the Carlson process. The principle of electrophotography is described in detail in reference to FIG. 6 through an example of the normal developing system adopted in photocopying machines. In the photocopying machine which employs the Carlson process, a charger 32, an exposure unit 33, a developer unit 34, a transfer unit 35, a fuser 36, a cleaner 37, and an eraser 38 are provided in this order along the circumference of a photoreceptor drum 31 having a photosensitive layer formed on the surface thereof as shown in FIG. 6.

With this arrangement, first, the surface of the photoreceptor drum 31 is uniformly charged by a charger 32 in a dark place. Next, an original image is illuminated on the surface of the photoreceptor drum 31 by the exposure unit 33 so as to remove charges from the illuminated portion, thereby forming an electrostatic latent image on the surface of the photoreceptor drum 31. Thereafter, a toner 39 is made to adhere to the electrostatic latent image, the toner 39 being charged by applying thereon a charge with a polarity opposite to the charge on the photoreceptor drum 31 in the developer unit 34, thereby forming a visible image with the toner 39. Further, a copying material 40 is superimposed on the visible image. Then, a corona-discharging is carried out by the transfer unit 35 from the back surface of the copying material 40 so as to apply a charge with a polarity opposite to the toner 39. As a result, the toner image is transferred to the copying material 40. Then, using heat and pressure from the fuser 36, the transferred toner image is made permanent on the copying material 40. On the other hand, a residual toner 39*a* remaining on the photoreceptor drum 31 after the transfer is removed by a cleaner 37. After the discharging operation is carried out from the electrostatic latent image on the photoreceptor drum 31 by projecting thereon a light beam from the eraser 38, the process starting with the charging operation by the charger 32 is repeated, thereby successively forming images.

In the discussed electrophotography, i.e., the application of the Carlson process, normally a corona discharger is adopted for charging the photoreceptor drum 31 or transferring the toner 39 to the copying material 40. However, when the corona discharger is adopted, high voltage of several kV is required. Moreover, it is likely to be affected by a change in the ambient condition, for example, a change in the charge amount on the surface of the photoreceptor drum 31 due to a temperature change. Furthermore, ozone produced in the process of corona charging results in problems concerning environmental health.

In order to counteract the above-mentioned problem, an image forming method not requiring the corona charging is disclosed in Japanese Laid-Open Publication 4900/1990 (Tokukouhei 2-4900). When adopting the method, as shown in FIG. 7, a photoreceptor 50 is desirably arranged such that a transparent electrically conductive layer 52 made of $In_2O_2$, etc., a photoconductive layer 53 made of Se etc., and a dielectric layer 54 made of polyethlene terephtalate film are laminated in this order on a transparent base 51 made of glass or the like. When a magnet 56 as a toner holder with an electrically conductive and magnetic toner 55 adhering thereto is brought close to the surface of the photoreceptor 50, in the mean time, the surface of the photoreceptor 50 is exposed from the side of a transparent base 51 while voltage is being applied across the magnet 56 and the transparent electrically conductive layer 52, the electric surface resistance of the photoconductive layer 53 at the illuminated portion is lowered, whereby a charge is injected under the dielectric layer 54. Then, a strong electric field is applied between the magnet 56 and the photoreceptor 50, thereby being injected a charge with a polarity opposite to that of the toner 55 corresponding to the exposed portion. As a result, the charged toner 55 and the charge injected through the transparent electrically conductive layer 52 become attracted to one another having the dielectric layer 54 in between by making pairs with charges of opposite polarities. In this way, even when the magnet 56 is moved away from the photoreceptor 50, the toner 55 at the exposed portion remains on the surface of the photoreceptor 50.

As described, the discussed method enables a toner image to be formed on the surface of the photoreceptor 50 without using the corona charging. After the toner image is formed on the surface of the photoreceptor 50, the toner image is transferred from the surface of the photoreceptor 50 to the surface of the copying material as in the case of the Carlson process. Thereafter, the copying material is transported to the fuser which melts the toner by heat treatment, whereby the toner image is permanently affixed to the copying material.

However, in the conventional image forming process using the electrically conductive toner 55, the efficiency in transferring the toner image on the copying material is easily affected by the electric surface resistance of the copying material. For example, in the case where the normal transfer sheet of relatively low surface resistance is used as a copying material, charges on the electrically conductive toner 55 are moved onto the transfer sheet when the transfer sheet gets in contact with the electrically conductive toner 55. As a result, the Coulomb force that is exerted between the transfer sheet and the electrically conductive toner 55 becomes weak. Therefore, it is difficult to carry out the transfer as desired.

In order to counteract this, for the described image forming process using the electrically conductive toner 55, the following methods have been proposed. These are, a method wherein pressure is applied mechanically to the toner image on the surface of the photoreceptor 50 and a method wherein the toner of the toner image is melted by heat treatment. However, the above methods have problems related to the mechanical strength and the heat resistance of the photoreceptor 50, and a costly special sheet whose surface is coated with a resin of high electric resistance is required for the copying material. Therefore, those methods have not yet been practically used.

Moreover, even if the costly special sheet is used, when the copying operation is performed under conditions of high humidity, the sheet absorbs moisture, and the electric surface resistance of the sheet is lowered, thereby reducing the efficiency of the transfer. As described, with the conventional electrophotographic printing machine, the efficiency in transferring the toner image onto the copying material is easily affected by the change in the ambient condition (humidity). For this reason, a stable toner image is difficult to obtain.

SUMMARY OF THE INVENTION

An object of the present invention is to provide an electrophotographic printing machine capable of forming images using an electrically conductive toner without producing ozone and always forming a stable toner image without being affected by a change in the ambient condition wherein a copying material of low electric surface resistance such as a normal copying material may be adopted.

Another object of the present invention is to provide a compact size electrophotographic printing machine.

Still another object of the present invention is to provide an electrophotographic printing machine which can be more efficiently maintained.

In order to achieve the above objects, the electrophotographic printing machine in accordance with the present invention is characterized in comprising: photoreceptor means including a base having an electrically conductive layer and a photoconductive layer laminated in this order; toner hold means for holding an electrically conductive toner and applying the electrically conductive toner to be in contact with the photoconductive layer; voltage application means for applying voltage across the electrically conductive toner and the electrically conductive layer; and exposure means for exposing a contacting area of the photoconductive layer, the contacting area being in contact with the electrically conductive toner, wherein a toner image is formed on the photoconductive layer by exposing the photoconductive layer by the exposure means while voltage is being applied across the electrically conductive toner and the electrically conductive layer, thereby forming a toner image on a surface of the photoconductive layer, further comprising: moving means in contact with the photoconductive layer of the photoreceptor means, with at least a surface in contact with the photoconductive layer thereof being dielectric; transfer means for transferring the toner image formed on the photoconductive layer of the photoreceptor means to the moving means; and melt transfer fixing means for melting the toner of the toner image that has been transferred onto the moving means and further transferring the toner image onto the copying material to be permanently affixed thereto.

In the above arrangement, the photoreceptor means includes the base having the electrically conductive layer and the photoconductive layer laminated in this order, and the electrically conductive toner held by the toner hold means is in contact with the photoconductive layer of the photoreceptor means. In this state, a charge is injected into the photoconductive layer through the electrically conductive toner while voltage is being applied across the electrically conductive toner and the electrically conductive layer by the voltage application means. Further, by exposing the contacting area of the photoconductive layer by the exposure means, the contacting area being in contact with the electrically conductive toner, the electric charge corresponding to an exposed portion of the photoconductive layer is neutralized, thereby forming a static latent image. Thereafter, since the electrically conductive toner held by the toner hold means is separated from the exposed portion of the photoreceptor means before the static latent image formed on the photoconductive layer disappears, the Coulomb force exerted between the electrically conductive toner and the static latent image becomes stronger than holding power of the toner hold means, thereby forming a toner image on the surface of the photoconductive layer corresponding to the static latent image.

The toner image formed on the photoconductive layer is transferred by the transfer means to the moving means which temporarily carries the toner image. Then, the melt transfer fixing means melts the toner of the toner image that has been transferred to the moving means, whereby the toner image is transferred to the copying material to be permanently affixed thereto.

As described, since the transfer of the electrically conductive toner to the copying material is done not directly by the photoreceptor means but through the moving means, after the toner of the toner image is melted, the toner image is transferred to the copying material to be permanently affixed thereto. Namely, since the melted toner is transferred to the transfer sheet using the adherence of the transfer sheet without using electric Coulomb force, the efficiency in transferring the toner image to the copying material is not affected by the electric surface resistance of the copying material. Thus, the special copying material (electric surface resistance) is not required for transferring the toner image, therefore copying materials of low electric surface resistance such as a normal transfer sheet may be used. With this arrangement, the stable transfer and fixing operations can always be performed without being affected by the change in the ambient condition (humidity).

Furthermore, since the transfer and fixing operations of the toner image are carried out simultaneously with respect to the copying material, when the toner image has been transferred to the copying material but has not yet been permanently affixed thereto, the copying material is not transported. The design for the transport path through which the copying material is transported is therefore free from restriction. This means that, the length of the transport path for the copying material can be shortened, thereby permitting the size of the apparatus to be trimmed. For example, the length of the transport path that links the copying material supply opening and the copying material discharge opening may be set shorter than the length of the copying material in the feed direction. Thus, the length of the apparatus can be made shorter than the length of the copying material in the feed direction.

In addition, the base of the photoreceptor means and the electrically conductive layer may be made of transparent material, and the base may be made in a cylindrical shape. It may also be arranged such that the exposure means is disposed in the base, and the photoconductive layer is exposed by projecting thereon a light through the base and the transparent electrically conductive layer.

With this arrangement, since the exposure means is disposed within the photoreceptor means, space for the exposure means is not separately required, thereby permitting the size of the apparatus to be significantly trimmed.

Furthermore, the electrophotographic printing machine of the present invention does not require a charger which deteriorates the photoconductive layer on the surface of the photoreceptor means nor the blade-shaped cleaner which wears out the photoconductive layer, the life of the photoreceptor means can therefore last as long as the melt transfer fixing means or the moving means. This means that the photoreceptor means, the moving means and the melt transfer fixing means all having substantially the same length of life are integrally provided as a unit within the apparatus, thereby improving the efficiency in maintaining the apparatus.

For a fuller understanding of the nature and advantages of the invention, reference should be made to the ensuing detailed description taken in conjunction with the accompanying drawings.

BRIEF DESCRIPTION OF THE DRAWINGS

FIG. 1 is a schematic view showing a configuration of an electrophotographic printing machine including a photoreceptor drum, a developer unit, an exposure unit and a dielectric belt.

FIG. 2 is a schematic view showing various components that constitute an electrophotographic printing machine.

FIG. 3 is an explanatory view showing the state when the surface of the photoreceptor drum is charged by coming in contact with the electrically conductive toner.

FIG. 4 is an explanatory view showing the state when the surface of the photoreceptor drum is neutralized by exposing by an exposure unit.

FIG. 5 is an explanatory view showing the state when a toner image is developed on the surface of the photoreceptor drum.

FIG. 6 is a typical depiction showing a configuration of an image forming apparatus adopting the conventional Carlson process.

FIG. 7 is a typical depiction of a cross-sectional view showing essential parts of an image forming apparatus wherein a conventional image forming process using an electrically conductive toner is applied.

DETAILED DESCRIPTION OF THE EMBODIMENTS

A first embodiment illustrating the present invention will be discussed hereinbelow with reference to FIGS. 1 through 5.

Figure 1:
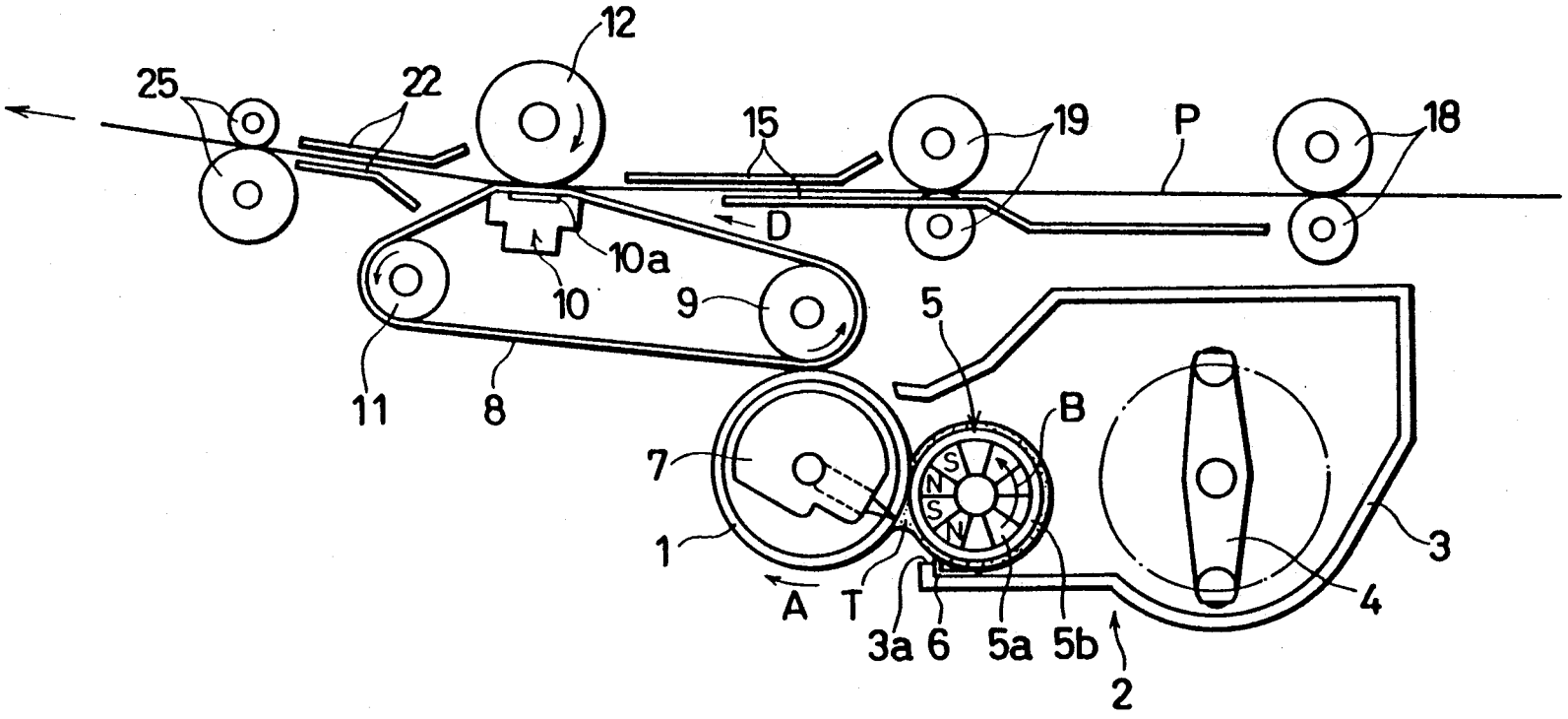
FIGS. 1 through 5 show one embodiment of the present invention.

As shown in FIG. 1, an electrophotographic printing machine in accordance with the present embodiment is provided with a cylindrical photoreceptor drum 1 (photoreceptor means) that is rotatable within the apparatus in the direction of arrow A. In the figure, a developer unit 2 is located on the right side of the photoreceptor drum 1 in which an exposure unit 7 (exposure means) is provided. Furthermore, a dielectric belt 8 (moving means) in contact with a photosensitive layer 1*c* of the photoreceptor drum 1 is provided above the photoreceptor drum 1, which moves in the direction of arrow D at the same speed as the peripheral speed of the photoreceptor drum 1.

Figure 3:
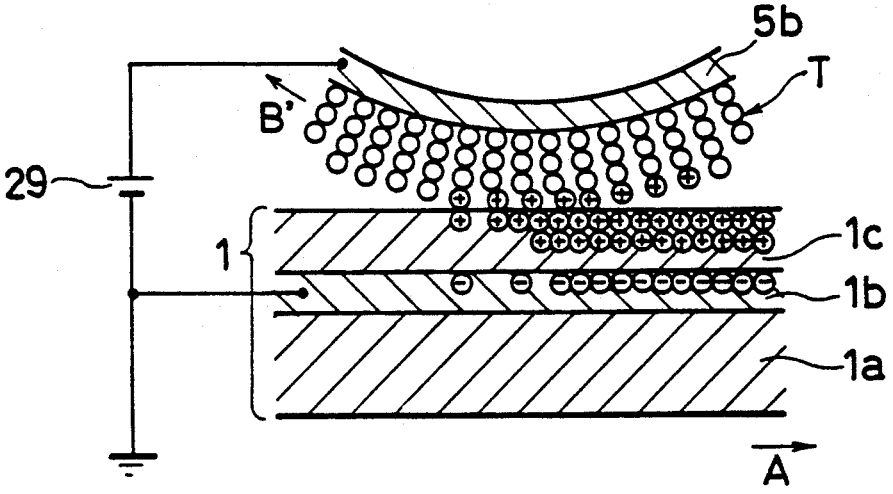

As shown in FIG. 3, the photoreceptor drum 1 is provided with a transparent cylindrical base 1*a* having a transparent electrically conductive layer 1*b* and a photoconductive layer 1*c* made of photoconductive material laminated in this order on the surface thereof. In the present embodiment, for the transparent electrically conductive layer 1*b*, a $In_2O_3$ layer with a thickness of substantially 0.5 μm is formed by sputtering $In_2O_3$. For the photoconductive layer 1*c*, an amorphous Si layer with a thickness of substantially 3 μm is formed. However, the transparent electrically conductive layer 1*b* is not limited to the $In_2O_3$ layer. Other than the $In_2O_3$ layer, for example, a $SnO_2$ layer may be preferably used. Similarly, the photoconductive layer 1*c* is not limited to the amorphous Si layer; other types of layer, for example, a Se layer, a ZnO layer or a CdS layer may be preferably used.

As shown in FIG. 1, the developer unit 2 includes a developer vessel 3 for storing an electrically conductive toner T as a developer; a mixing roller 4 for mixing the electrically conductive toner T, the mixing roller 4 being rotatively provided in the developer vessel 3; a toner holder 5 placed in an opening 3*a* of the developer vessel 3 so as to confront the photoreceptor drum 1 and a doctor blade 6 affixed to a position under the toner holder 5 in the opening 3*a* of the developer vessel 3.

The toner holder 5 which extends in an axis direction of the photoreceptor drum 1 includes: a magnetic roller 5*a* which has N polarity magnets and S polarity magnets that are alternatively disposed in a circumferential direction; and a developer sleeve 5*b* which surrounds the periphery surface of the magnetic roller 5*a*. The developer sleeve 5*b* is made of a non-magnetic material such as aluminum or martensite series stainless steel. The toner holder 5 is arranged as follows. First, an alternating field is generated when the magnetic roller 5*a* rotates in the direction of arrow B, then the toner holder 5 holds the electrically conductive toner T on the surface of a developer sleeve 5*b* and transports the electrically conductive toner T in the direction of arrow B' that is opposite to the rotating direction B of the magnetic roller 5*a* (see FIG. 3). Then, the amount of the electrically conductive toner T on the surface of the developer sleeve 5*b* that has been transported in the direction of arrow B' is adjusted to a predetermined amount by the doctor blade 6.

The electrically conductive toner T is produced by the following way. Powdered magnetic material such as powdered iron or ferrite and carbon black is mixed into a resin made of styrene-acrylic copolymer by kneading. The mixture is ground into particles ranging from several μm to several tens μm, in order to obtain the electrically conductive toner T.

The exposure unit 7 is arranged so as to include a light emitting diode (LED) arrey wherein a plurality of lens having a short focal distance and LEDs are combined. The exposure unit 7 projects a light beam in response to an exposure pattern signal from an exposure controlling unit (not shown) towards the developer unit 2 so that the light beam is converged onto the photoconductive layer 1*c* through the transparent base 1*a* and the transparent electrically conductive layer 1*b* of the photoreceptor drum 1.

The dielectric belt 8 that is belt-shaped with no end is made of film material including mainly polyimide which is superior in its mechanical strength and heat resistance. The dielectric belt 8 goes around a transfer roller 9 (transfer means) set above the photoreceptor drum 1, and a heater 10 (melt transfer fixing means and heating means), to be described later, placed on the left side and slightly upper side of the transfer roller 9 and a tension roller 11 located on the left side and slightly lower side of the heater 10 in the figure. The dielectric belt 8 is set between the photoreceptor drum 1 and the transfer roller 9.

For the dielectric belt 8, a film-shaped polyimide resin is used in the present embodiment. However, the present invention is not intended to be limited to this material, and other material may be used as long as the surface on which the electrically conductive toner T is transferred (i.e., the surface in contact with the photoreceptor drum 1) is dielectric. The dielectric belt 8 may be made of the polyimide resin or, for example, the dielectric belt 8 could be made of a metal belt having a dielectric layer formed on the surface in contact with the photoreceptor drum 1. Here, an electric cast nickel belt is preferably used for the metal belt, and the dielectric layer is preferably formed by coating the surface of the metal belt with fluorocarbon polymers. Although, it is not necessary to specify the thickness of the dielectric belt 8, considering its thermal conductivity and mechanical strength, thickness of substantially 10 μm to 200 μm is preferable. In addition, for the purpose of making the gloss of the image appropriate, the surface of the dielectric belt 8 may be rough.

As will be described later, the heater 10 is provided for melting the electrically conductive toner T by heat treatment, that to be transferred to the surface of the dielectric belt 8. The heater 10 is designed to be a ceramic heater having a plane-shaped Mo series electric resistance heater 10*a* (plane-shaped electric heating element) and a glass coat laminated on an alumina ceramic substrate in this order by printing. Further, the heater 10 is arranged such that the temperature of the heating surface thereof is rapidly raised up to a predetermined heating temperature by conducting through the electric resistance heater 10*a*. The heating surface is in direct contact with the surface of the dielectric belt 8.

A pressurizing roller 12 (melt transfer fixing means and pressurizing means) is provided above the heater 10, which rotates in the direction towards the heater 10 while pressing force is being exerted through the dielectric belt 8. The pressurizing roller 12 is arranged so as to press a transfer sheet P (copying material) towards the dielectric belt 8 whereon the transfer sheet P is being transported by the copying material transport means 26 (to be described later).

Figure 2:
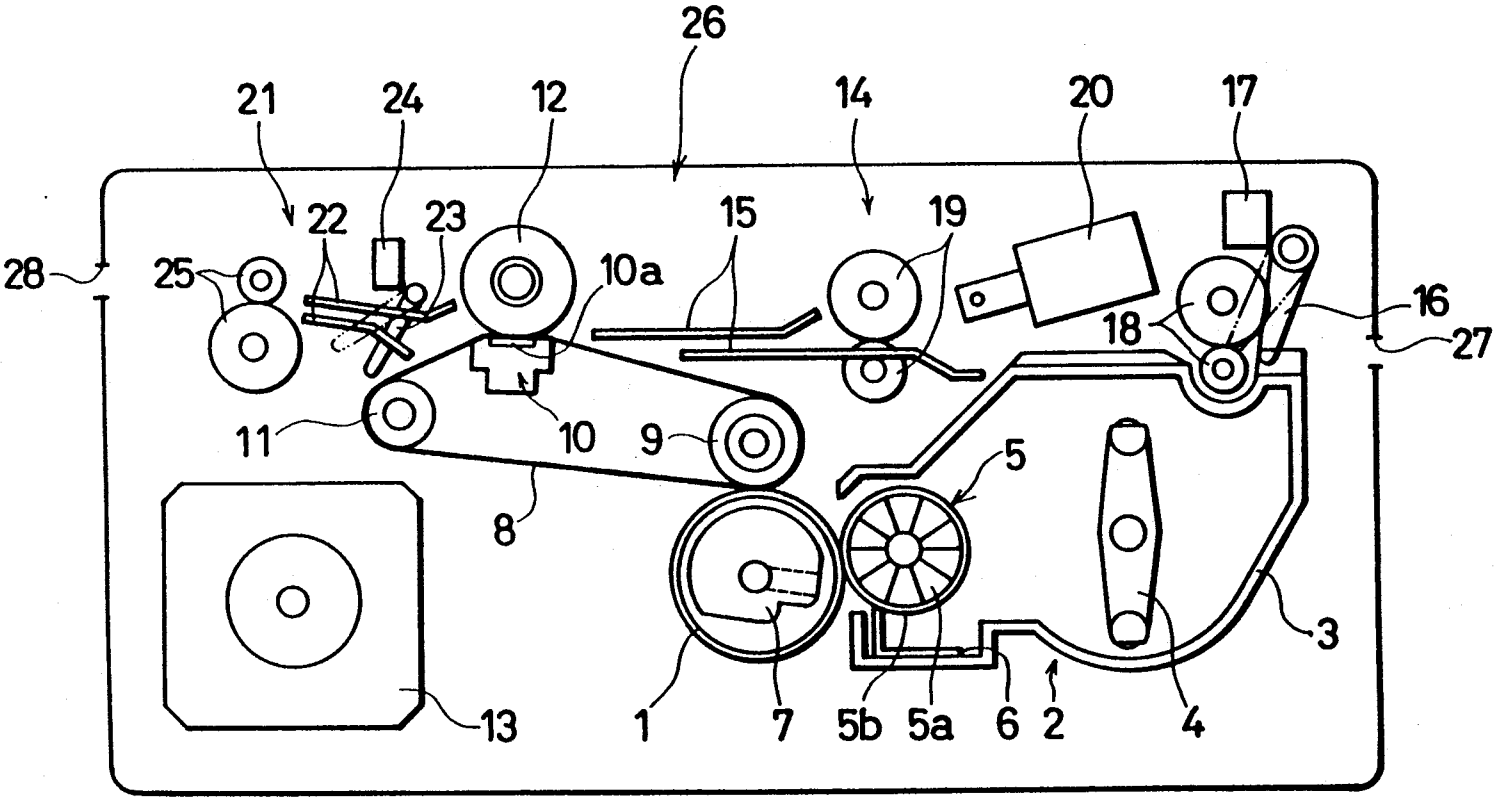

As shown in FIG. 2, the electrophotographic printing machine in accordance with the present embodiment is provided with a stepping motor 13 as a drive source of the apparatus. The electrophotographic printing machine is further provided with the copying material transport means 26 including a feed side transport section 14 and a discharge side transport section 21. The feed side transport section 14 is provided for transporting the transfer sheet P fed into the apparatus to the pressurized portion of the transfer sheet P between the dielectric belt 8 and the pressurizing roller 12. The discharge side transport section 21 is provided for discharging the transfer sheet P from the apparatus.

The copying material transport means 26 is placed above the photoreceptor drum 1, the developer unit 2 and the dielectric belt 8. The feed side transport section 14 of the copying material transport means 26 includes a transport guide plate 15, a feed detection actuator 16, a feed detection switch 17, a feed roller 18, a register roller 19 and a register roller solenoid 20. The transport guide plate 15 is provided for making a first transport path that links a transfer sheet supply opening 27 and the pressurized portion of the transfer sheet P between the dielectric belt 8 and the pressurizing roller 12. The feed detection actuator 16, the feed detection switch 17 and the feed roller 18 are provided in the vicinity of the transfer sheet supply opening 27. The register roller 19 is provided along the first transport path formed by the transport guide plate 15. The register roller solenoid 20 controls the rotation of the register roller 19.

In the figure, the discharge side transport section 21 of the copying material transport means 26 is located on the left side of the pressurized portion of the transfer sheet P between the dielectric belt 8 and pressurizing roller 12. The discharge side transport section 21 includes a discharge guide plate 22, a discharge detection actuator 23, a discharge detection switch 24 and a discharge roller 25. The discharge guide plate 22 forms a second transport path that links the pressurized portion of the transfer sheet P between the dielectric belt 8 and the pressurizing roller 12 and a transfer sheet discharge opening 28. The discharge detection actuator 23 and the discharge detection switch 24 are placed in the vicinity of the pressurized portion of the transfer sheet P between the dielectric belt 8 and the pressurizing roller 12. The discharge roller 25 is placed at the end of the discharge guide plate 22.

Here, it is arranged such that the length of the transport path that links the transfer sheet supply opening 27 and the transfer sheet discharge opening 28 (i.e., the length of the first transport path+the length of the second transport path) is shorter than the length of the transfer sheet P in the transport direction. In addition, in the case of the electrophotographic printing device wherein the transfer sheet P of different sizes such as A4 size or B5 size can be used, the length of the transport path is preferably set shorter than the length of the smallest size transfer sheet P in the feed direction.

In the electrophotographic printing machine, the described dielectric belt 8, the heater 10 placed on an inner side of the dielectric belt 8 and the photoreceptor drum 1 being welded to the dielectric belt 8 are integrally provided as a unit in the apparatus.

An operating procedure of the discussed electrophotographic printing machine will be described hereinbelow.

First, a piece of transfer sheet P is fed into the apparatus by the transfer sheet supply means (not shown) through the transfer sheet supply opening 27. Here, as the leading edge of the transfer sheet P pushes up the feed detection actuator 16, the feed detection switch 17 detects that the transfer sheet P is fed, and a feed detection signal is sent to the stepping motor 13 which serves as a drive source.

The rotation of the stepping motor 13 is transmitted to the feed roller 18 through a rotation transmission mechanism (not shown), thereby rotating the feed roller 18. With the rotation of the feed roller 18, the transfer sheet P is transported to the register roller 19.

The transfer sheet P that has been transported to the register roller 19 is temporarily stopped as the register roller 19 stops rotating under control of the register roller solenoid 20. In this state, a pair of the feed rollers 18 sandwich the transfer sheet P. Here, since the frictional resistance of the surfaces of the rollers 18 is very small, the feed rollers 18 slip on both surfaces of the transfer sheet P when the transfer sheet P is stopped from being transported.

Figure 4:
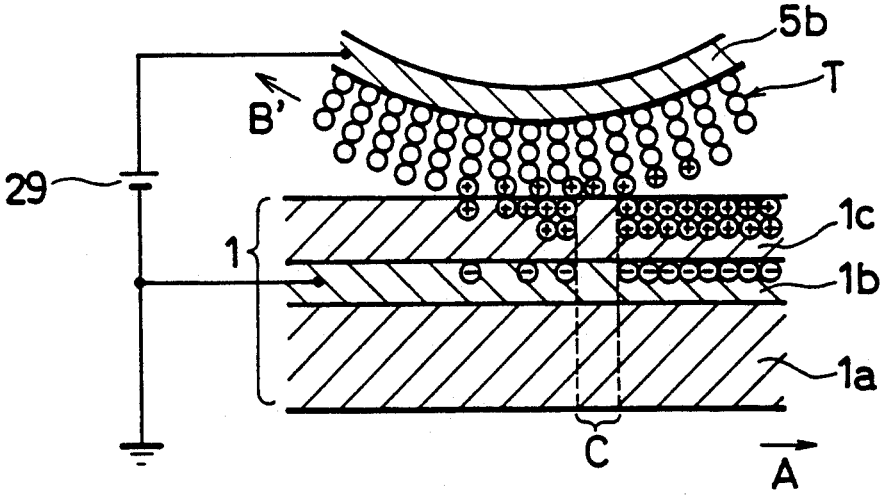
Figure 5:
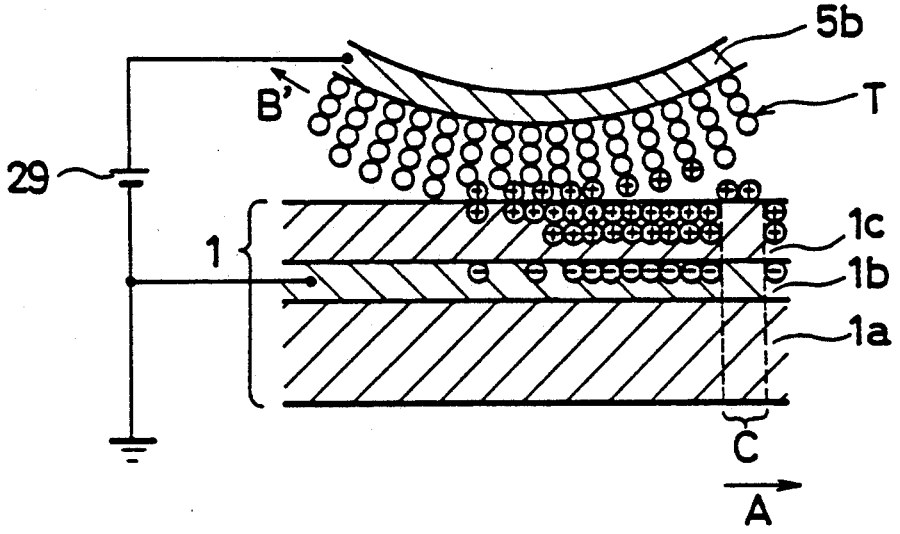
Figure 6:
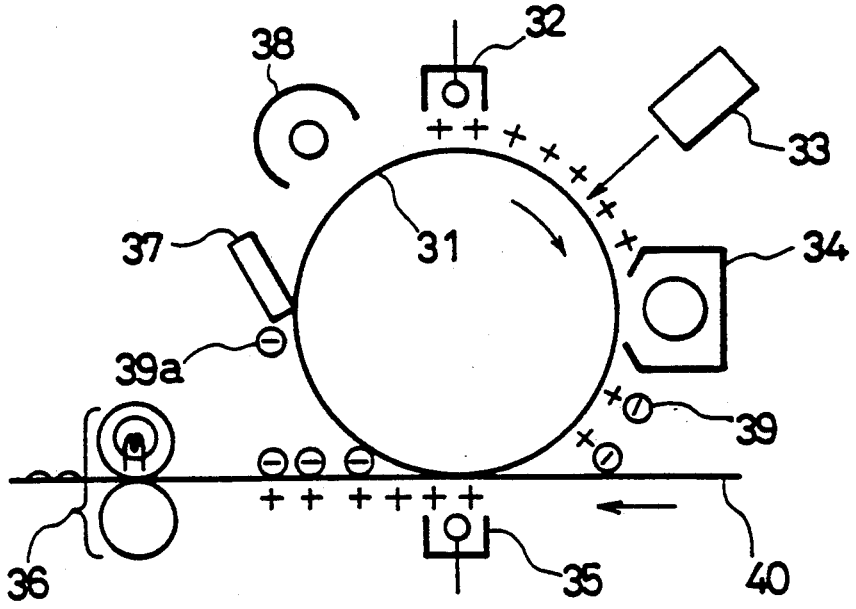
FIG. 6 PRIOR ART
FIGS. 6 and 7 show the prior art.
Figure 7:
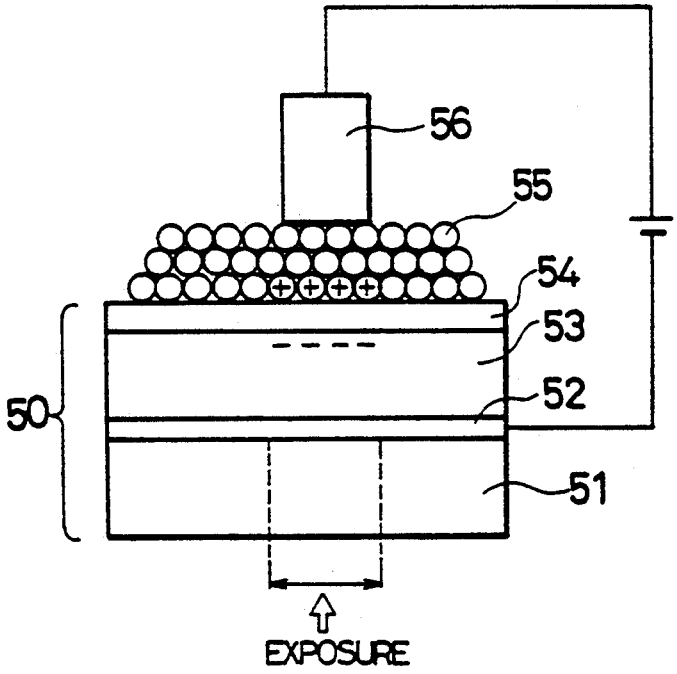
FIG. 7 PRIOR ART

The developing process of the electrically conductive toner T is described hereinbelow with reference to FIGS. 3 to 5.

First, as shown in FIG. 3, the electrically conductive toner T stored in the developer vessel 3 is held on the surface of the developer sleeve 5*b* by an alternating magnetic field generated when the magnetic roller 5*a* rotates in the direction of arrow B (see FIG. 1), in the mean time, the electrically conductive toner T is transported on the surface of the developer sleeve 5*b* in the direction of arrow B', i.e., a direction opposite to the rotating direction A of the photoreceptor drum 1. Here, in the contacting area between the electrically conductive toner T on the surface of the developer sleeve 5*b* and the photoreceptor drum 1, the injection of the electric charge is carried out into the photoreceptor drum 1 from the developer sleeve 5*b* through the electrically conductive toner T when a power supply 29 (voltage application means) applies voltage of several tens V across the developer sleeve 5*b* and the transparent electrically conductive layer 1*b*. As a result, the surface of the photoreceptor drum 1 is charged so as to have substantially the same electric potential as the developer sleeve 5*b*.

The electrically conductive toner T in contact with the photoreceptor drum 1 does not adhere to the photoreceptor drum 1 because the Coulomb force exerted between the electrically conductive toner T and the surface of the photoreceptor drum 1 becomes extremely weak as it has the same electric potential as the developer sleeve 5*b*, the Coulomb force is therefore cancelled out by the magnetic force generated by the magnetic roller 5*a*.

With the above state, an exposing operation is carried out by the exposure unit 7. More concretely, as shown in FIG. 4, in the exposure unit 7, the LED corresponding to the image pattern is selected in order, and a light is projected onto the contacting area between the photoreceptor 1 and the electrically conductive toner T by the exposure unit 7. As a result, the electric charge corresponding to the exposed portion C of the photoconductive layer 1*c* on the surface of the photoreceptor drum 1 is neutralized, thereby forming a static latent image corresponding to the image pattern.

As described, since the static latent image is formed on the photoconductive layer 1*c* on the surface of the photoreceptor drum 1, an electric potential difference arises between the photoconductive layer 1*c* and the developer sleeve 5*b*. With this electric potential difference, the injection of electric charge is carried out again into the photoreceptor drum 1 from the developer sleeve 5*b* through the electrically conductive toner T. Here, the electrically conductive toner T is separated from the exposed portion C of photoreceptor drum 1 before a sufficient amount of electric charge is injected (i.e., before the electric static latent image disappears). For this reason, the Coulomb force is exerted between the electrically conductive toner T, which is in contact with the surface of the photoreceptor drum 1 corresponding to the exposed portion C, and the surface of the photoreceptor drum 1, that is stronger than the magnetic force of the magnetic roller 5*a*. As a result, the electrically conductive toner T in contact with the surface of the photoreceptor drum 1 corresponding to the exposed portion C is separated from the side of the developer sleeve 5*b* and maintained on the surface of the photoreceptor drum 1, thereby forming a toner image corresponding to the image pattern on the surface of the photoreceptor drum 1.

As described, the toner image formed on the surface of the photoreceptor drum 1 is transported to the portion where the dielectric belt 8 is pressurized by the photoreceptor drum 1 and the transfer roller 9 which rotates in the direction of arrow A as shown in FIG. 1. Then, voltage with a polarity opposite to the injected electric charge of the toner image is applied to the transfer roller 9. As a result, the toner image on the surface of the photoreceptor drum 1 is transferred onto the surface of the dielectric belt 8 moving at the same speed as the peripheral speed of the photoreceptor drum 1.

Thereafter, the toner image that has been transferred onto the surface of the dielectric belt 8 is transported to the pressurized portion of the transfer sheet P between the dielectric belt 8 and the pressurizing roller 12 by the dielectric belt 8 moving in the direction of arrow D. Further, the CPU (Central Processing Unit) of the engine controller (not shown) sends out a signal to the register roller solenoid 20 of FIG. 2 so that the toner image on the surface of the dielectric belt 8 corresponds to the transfer sheet P at the pressurized portion of the transfer sheet P between the dielectric belt 8 and the pressurizing roller 12. Then, the register roller 19 is released from the stop state, thereby transporting the transport sheet P to the pressurized portion of the transfer sheet P between the dielectric belt 8 and the pressurizing roller 12.

The transfer sheet P is superimposed onto the toner image by the heater 10 and the pressurizing roller 12 from the dielectric belt 8 which carries the toner image thereon. In this way, the transfer and fixing operations of the toner image to the transfer sheet P are carried out simultaneously. That is, when the transfer sheet P is transported while being pressurized between the dielectric belt 8 and the pressurizing roller 12, the electrically conductive toner T on the surface of the dielectric belt 8 is melted by heat treatment of the heater 10. In this case, the melted electrically conductive toner T is separated from the surface of the dielectric belt 8 more easily than from the surface of the transfer sheet P. Therefore, almost all the electrically conductive toner T can be transferred and permanently affixed to the transfer sheet P without the toner remaining on the dielectric belt 8.

Thereafter, the transfer sheet P whereon the toner image is transferred and permanently affixed thereto pushes up the discharge detection actuator 23 and discharged from the apparatus through the transfer sheet discharge opening 28 with rotations of the discharge roller 25. Then, after a predetermined elapse of time when neither the feed detecting signal nor the discharge detecting signal from the feed detection switch 24 are generated, voltage to the heat resistor 10*a*, of the heater 10, and the driving of the stepping motor 13 are stopped indicating an end of the above sequential process.

As described, with the electrophotographic printing machine of the present invention, the surface of the photoreceptor drum 1 is charged by making the electrically conductive toner T held by the toner holder 5 in contact with the photoreceptor drum 1, and the exposure unit 7 exposes the photoreceptor drum 1 from inside, thereby forming the toner image corresponding to the image pattern on the surface of the photoreceptor drum 1.

With the above arrangement, a charger such as a corona discharger is not required, therefore, the possibility of producing ozone in the process of charging is eliminated. Moreover, since the exposure unit 7 is provided within the photoreceptor drum 1, the size of the apparatus can be significantly trimmed.

The toner image thus formed on the surface of the photoreceptor drum 1 is transferred to the dielectric belt 8 which temporarily carries the toner image. Heat and pressure are applied to the toner image respectively from the heater 10 and the pressurizing roller 12 on the dielectric belt 8. Thus, the toner is melted, and the transfer and fixing operations of the toner image can be carried out simultaneously with respect to the transfer sheet P. In the above embodiment, since the toner image is transferred to the transfer sheet P using the adherence of the transfer sheet P to the melted toner without using electric Coulomb force, the efficiency in transferring the toner image to the copying material (transfer sheet P) is not affected by the electric surface resistance of the copying material. The electrophotographic printing machine does not require special copying material (electric surface resistance) for transferring the toner image, and a copying material of low electric surface resistance such as a normal transfer sheet may be used. As a result, the stable transfer and fixing operations can always be performed without being affected by the change in the ambient condition (humidity).

Furthermore, with the electrophotographic printing machine, since the transfer and fixing operations of the toner image are carried out simultaneously with respect to the copying material, when the toner image has been transferred to the copying material but has not yet been permanently affixed thereto, the copying material is not transported. The design for the transport path through which the copying material is transported is therefore free from restriction. In addition, it can be arranged such that the length of the transport path that links the transfer sheet supply opening 27 and the transfer sheet discharge opening 28 is shorter than the length of the transfer sheet in the feed direction. As a result, the width of the apparatus can be made shorter than the length of the transfer sheet P in the feed direction. As described, the electrophotographic printing machine in accordance with the present invention permits a shortening of the time required for forming images and reduces the possibility of the paper being stuck in the apparatus by making the transport distance of the transfer sheet P shorter.

Furthermore, the electrophotographic printing machine of the present invention does not require a charger which deteriorates the surface of the photoreceptor drum 1 nor the blade-shaped cleaner which wears out the surface of the photoreceptor drum 1, the life of the photoreceptor drum 1 can last as long as the dielectric belt 8 or the heater 10. This means that the photoreceptor drum 1, the dielectric belt 8 and the heater 10 all having substantially the same length of life are integrally provided as a unit within the apparatus, thereby improving the efficiency in maintaining the apparatus.

Additionally, it should be understood that the present invention is not intended to be limited to the above preferred embodiment. For example, in the above embodiment, for the photoreceptor whereon the toner image is formed on the surface thereof, the photoreceptor drum 1 has been used, which has the transparent electrically conductive layer 1*b* and the photoconductive layer 1*c* laminated in this order on the periphery surface of the transparent base 1*a*; however, the present invention is not intended to be limited to this. Other arrangements may be equally adopted as long as the electrically conductive toner T can be in contact with the photosensitive layer from one side, and the exposure unit 7 can be set on the other side of the photoreceptor. Thus, a plate-shape may be used as well. In addition, if organic material is used, the photoreceptor may be formed in a belt-shape.

An electrophotographic printing machine in accordance with the present invention is provided with photoreceptor means including a base having an electrically conductive layer and a photoconductive layer laminated in this order on a surface thereof; toner hold means for holding an electrically conductive toner to be applied on the surface of the electrically conductive layer; voltage application means for applying voltage across the toner hold means and the electrically conductive layer; and exposure means for exposing a contacting area of the photoconductive layer, the contacting area being in contact with the electrically conductive toner. The electrophotographic printing machine is arranged to form a toner image on the photoconductive layer by exposing the photoconductive layer by the exposure means while voltage is being applied across the electrically conductive toner and the electrically conductive layer by the voltage application means. The electrophotographic printing machine is further provided with moving means in contact with the photoconductive layer of the photoreceptor means, with at least the surface in contact with the photoconductive layer thereof being dielectric; transfer means for transferring the toner image formed on the photoconductive layer of the photoreceptor means to the moving means; and melt transfer fixing means for melting the toner of the toner image transferred to the moving means and further transferring the toner image to the copying material to be permanently affixed thereto.

In the above embodiment, since the toner image is transferred to the transfer sheet using the adherence of the transfer sheet to the melted toner without using electric Coulomb force, the efficiency in transferring the toner image to the copying material is not affected by the electric surface resistance of the copying material. According to the above arrangement, the image can be formed using the electrically conductive toner without producing Ozone, and the method does not require special copying material (electric surface resistance) for transferring the toner image, and thus a copying material of low electric surface resistance such as a normal transfer sheet may be used. Further, stable transfer and fixing operations can always be performed without being affected by the change in the ambient condition (humidity).

Further, with the electrophotographic printing machine, since the transfer and fixing operations of the toner image are carried out simultaneously with respect to the copying material, when the toner image has been transferred to the copying material but has not yet been permanently affixed thereto, the copying material is not transported. For this reason, the design for the transport path through which the copying material is transported is free from restriction. Therefore, the transport distance of the copying material can be shortened, thereby permitting the size of the apparatus to be trimmed.

The electrophotographic printing machine of the present invention having the described configuration further includes copying material transport means having a copying material transport path that links the copying material supply opening through which the copying material is fed into the apparatus and the copying material discharge opening through which the copying material is discharged from the apparatus, for transporting the copying material to the melt transfer fixing means through the copying material transport path. Here, the length of the copying material transport path is set shorter than the length of the copying material in the transport direction.

In this way, the width of the apparatus can be made shorter than the length of the copying material in the transport direction.

In the arrangement of the electrophotographic printing machine of the present invention, the photoreceptor means is a photoreceptor drum including a transparent cylindrical base having a transparent electrically conductive layer and a photoconductive layer laminated in this order on a periphery surface thereof, and the exposure means is provided in the photoreceptor drum. The photoconductive layer is exposed by projecting thereon a light through the transparent base and the transparent electrically conductive layer.

Therefore, special space for the exposure means is not required, thereby permitting the size of the apparatus to be trimmed.

In the electrophotographic printing machine of the present invention, the melt transfer fixing means, the moving means and the photoreceptor means are integrally provided as a unit in the apparatus.

As described, since the components having substantially the same length of life are integrally provided as a unit within the apparatus, the efficiency in maintaining the apparatus can be improved.

While this invention has been disclosed in conjunction with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

What is claimed is:

1. An electrophotographic printing machine comprising:

photoreceptor means including a base having an electrically conductive layer and a photoconductive layer laminated in this order;

toner hold means for holding an electrically conductive toner and applying the electrically conductive toner to be in contact with the photoconductive layer;

voltage application means for applying voltage across the electrically conductive toner and the electrically conductive layer; and exposure means for exposing a contacting area of the photoconductive layer, the area being in contact with the electrically conductive toner;

wherein a toner image is formed on the photoconductive layer by exposing the photoconductive layer by said exposure means while voltage is being applied across the electrically conductive toner and the electrically conductive layer, thereby forming a toner image on a surface of the photoconductive layer, further comprising:

moving means in contact with the photoconductive layer of said photoreceptor means, with at least a surface in contact with the photoconductive layer thereof being dielectric;

transfer means for transferring the toner image formed on the photoconductive layer of said photoreceptor means to said moving means; and melt transfer fixing means for melting toner of the toner image that has been transferred to said moving means and further transferring the toner image onto a copying material to be permanently affixed thereto;

wherein said moving means includes a metal belt and a dielectric layer formed on a surface thereof, the dielectric layer being in contact with said photoreceptor means.

2. The electrophotographic printing machine as set forth in claim 1, wherein:

the metal belt is an electric cast nickel belt; and the dielectric layer is formed by coating a surface of the metal belt with fluorocarbon polymers.

3. An electrophotographic printing machine comprising:

photoreceptor means including a base having an electrically conductive layer and a photoconductive layer laminated in this order;

toner hold means for holding an electrically conductive toner and applying the electrically conductive toner to be in contact with the photoconductive layer;

voltage application means for applying voltage across the electrically conductive toner and the electrically conductive layer; and exposure means for exposing a contacting area of the photoconductive layer, the area being in contact with the electrically conductive toner;

wherein a toner image is formed on the photoconductive layer by exposing the photoconductive layer by said exposure means while voltage is being applied across the electrically conductive toner and the electrically conductive layer, thereby forming a toner image on a surface of the photoconductive layer, further comprising:

moving means in contact with the photoconductive layer of said photoreceptor means, with at least a surface in contact with the photoconductive layer thereof being dielectric;

transfer means for transferring the toner image formed on the photoconductive layer of said photoreceptor means to said moving means; and melt transfer fixing means for melting toner of the toner image that has been transferred to said moving means and further transferring the toner image onto a copying material to be permanently affixed thereto;

wherein said base of said photoreceptor means is a transparent cylindrical base;

the electrically conductive layer is a transparent electrically conductive layer; and said photoreceptor means is a photoreceptor drum having the transparent electrically conductive layer and the photoconductive layer laminated in this order on a periphery surface of said transparent cylindrical base;

and further wherein the transparent electrically conductive layer is a $In_2O_3$ layer with a thickness of substantially 0.5 $\mu$m.

4. An electrophotographic printing machine comprising:

photoreceptor means including a base having an electrically conductive layer and a photoconductive layer laminated in this order;

toner hold means for holding an electrically conductive toner and applying the electrically conductive toner to be in contact with the photoconductive layer;

voltage application means for applying voltage across the electrically conductive toner and the electrically conductive layer; and exposure means for exposing a contacting area of the photoconductive layer, the area being in contact with the electrically conductive toner;

wherein a toner image is formed on the photoconductive layer by exposing the photoconductive layer by said exposure means while voltage is being applied across the electrically conductive toner and the electrically conductive layer, thereby forming a toner image on a surface of the photoconductive layer, further comprising:

moving means in contact with the photoconductive layer of said photoreceptor means, with at least a surface in contact with the photoconductive layer thereof being dielectric;

transfer means for transferring the toner image formed on the photoconductive layer of said photoreceptor means to said moving means;

melt transfer fixing means for melting toner of the toner image that has been transferred to said moving means and further transferring the toner image onto a copying material to be permanently affixed thereto; and copying material transport means having a copying material transport path that links a copying material supply opening through which the copying material is fed into the apparatus and a copying material discharge opening through which the copying material is discharged from the apparatus, for transporting the copying material to said melt transfer fixing means through the copying material transport path;

wherein a length of the copying material transport path is set shorter than a length of the copying material in a transport direction.

5. An electrophotographic printing machine comprising:

photoreceptor means including a base having an electrically conductive layer and a photoconductive layer laminated in this order;

toner hold means for holding an electrically conductive toner and applying the electrically conductive toner to be in contact with the photoconductive layer;

voltage application means for applying voltage across the electrically conductive toner and the electrically conductive layer; and exposure means for exposing a contacting area of the photoconductive layer, the area being in contact with the electrically conductive toner;

wherein a toner image is formed on the photoconductive layer by exposing the photoconductive layer by said exposure means while voltage is being applied across the electrically conductive toner and the electrically conductive layer, thereby forming a toner image on a surface of the photoconductive layer, further comprising:

moving means in contact with the photoconductive layer of said photoreceptor means, with at least a surface in contact with the photoconductive layer thereof being dielectric;

transfer means for transferring the toner image formed on the photoconductive layer of said photoreceptor means to said moving means; and melt transfer fixing means for melting toner of the toner image that has been transferred to said moving means and further transferring the toner image onto a copying material to be permanently affixed thereto;

wherein said base of said photoreceptor means is a transparent cylindrical base;

the electrically conductive layer is a transparent electrically conductive layer; and said photoreceptor means is a photoreceptor drum having the transparent electrically conductive layer and the photoconductive layer laminated in this order on a periphery surface of said transparent cylindrical base;

and further wherein the photoconductive layer is an amorphous Si layer with a thickness of substantially 3 μm.

* * * * *